US006796213B1

(12) United States Patent
McKendree et al.

(10) Patent No.: US 6,796,213 B1
(45) Date of Patent: Sep. 28, 2004

(54) METHOD FOR PROVIDING INTEGRITY BOUNDING OF WEAPONS

(75) Inventors: Thomas L. McKendree, Huntington Beach, CA (US); John D. Britigan, Orange, CA (US); Hans L. Habereder, Orange, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/444,938

(22) Filed: May 23, 2003

(51) Int. Cl.[7] ..... F41F 5/00
(52) U.S. Cl. ..... 89/1.11
(58) Field of Search ..... 89/1.11

(56) References Cited

U.S. PATENT DOCUMENTS 3,636,323 A * 1/1972 Salisbury et al. ..... 701/220
4,530,270 A * 7/1985 Denaci ..... 89/1.11
5,760,737 A * 6/1998 Brenner ..... 342/357.02
5,881,969 A * 3/1999 Miller ..... 244/3.17
6,067,484 A * 5/2000 Rowson et al. ..... 701/16
6,474,592 B1 * 11/2002 Shnaps ..... 244/3.15
6,522,250 B1 * 2/2003 Ernst et al. ..... 340/539.1
2003/0213358 A1 * 11/2003 Harding ..... 89/1.11

OTHER PUBLICATIONS

GPS Safety Net GPS–Loran Type Prototype Processor, Linn Roth and Jim Doty, GPS World (http://www.gpsworld.com), May 1, 2003.*

* cited by examiner

*Primary Examiner*—Jack Keith
*Assistant Examiner*—Troy Chambers
(74) *Attorney, Agent, or Firm*—Daly, Crowley & Mofford, LLP.

(57) ABSTRACT

A method for providing integrity bounding of a weapon for use in weapon selection and targeting is presented. The method determines an integrity bound for the weapon, the integrity bound defining a zone around the target aim-point within which engagement must occur to meet a predetermined integrity level (i.e., a probability of engagement within an allowable engagement zone). A method of assigning weapons for engaging a target is also presented. The method includes determining an aim-point of a target and determining an alert limit for the aim-point, the alert limit comprising a zone that includes the aim-point and excludes any friendly sites. Weapon selection is then performed by selecting a weapon having an integrity bound less than or equal to the alert limit.

7 Claims, 7 Drawing Sheets

METHOD FOR PROVIDING INTEGRITY BOUNDING OF WEAPONS

CROSS REFERENCE TO RELATED APPLICATIONS

Not Applicable.

STATEMENT REGARDING FEDERALLY SPONSORED RESEARCH

Not Applicable.

FIELD OF THE INVENTION

The present invention relates generally to weapon targeting and more specifically to weapon targeting using integrity bounds associated with the particular weapon.

BACKGROUND OF THE INVENTION

Modern warfare often involves intended targets (such as enemy troops) located close to targets one wishes to protect (such as civilian population and friendly troops). While it is desirable to engage intended targets, care must be used to minimize or eliminate unintentional engagement of unintended targets, such as friendly troops and collateral damage of neutral targets.

In modern warfare the targeting of enemy sites is typically focused on the increasing probability of munitions hitting the desired target, typically with means to improve overall weapon accuracy. Certain countries or groups of people place air defense systems and other military significant systems near buildings such as hospitals, schools or places of religious worship (e.g. churches, temples or mosques) in hope that an attempted targeting of the military significant systems will be tempered by the desire not to hurt civilians in the hospitals, schools or places of religious worship or to harm the buildings themselves.

Present day munitions used in warfare are increasingly Precision Guided Munitions (PGMs). A "PGM" is a munition with sensors that allow it to know where it is and actuators that allow the munition to guide itself towards an intended target. The PGM's guidance system provides a generally accurate target area for the munitions to strike. These munitions target an aim-point. The aim-point has an area around it referred to as the Circular Error Probable (CEP). The CEP defines an area about an aim-point for a munition wherein approximately fifty percent of the munitions aimed at the aim-point of the target will strike. While fifty percent of the munitions will strike within the CEP area, the remaining fifty percent will strike outside the CEP area, in some cases potentially very far away. It is munitions that strike away from the intended target that result in unintentional engagement of friendly troops or friendly sites or provide collateral damage to civilians and civilian structures.

One system used to provide guidance of a PGM is known as a Laser Guidance System (LGS) used with Laser Guided Bombs (LGBs). In use, a LGB maintains a flight path established by the delivery aircraft. The LGB attempts to align itself with a target that is illuminated by a laser. The laser may be located on the delivery aircraft, on another aircraft or on the ground. When alignment occurs between the LGB and the laser, the reflected laser energy is received by a detector of the LGB and is used to center the LGB flight path on the target.

Another type of PGM is known as an Inertial Guided Munition (IGM). The IGM utilizes an inertial guidance system (IGS) to guide the munition to the intended target. This IGS uses a gyroscope and accelerometer to maintain the predetermined course to the target.

Still another type of PGM is referred to as Seeker Guided Munitions (SGMs). The SGMs attempt to determine a target with either a television or an imaging infrared seeker and a data link. The seeker subsystem of the SGM provides the launch aircraft with a visual presentation of the target as seen from the munition. During munition flight, this presentation is transmitted by the data-link system to the aircraft cockpit monitor. The SGM can be either locked onto the target before or after launch for automatic munition guidance. As the target comes into view, the SGM locks onto the target.

Another navigation system used for PGMs is known as a Global Positioning System (GPS). GPS is well known to those in the aviation field for guiding aircraft. GPS is a satellite navigation system that provides coded satellite signals that are processed by a GPS receiver and enable the receiver to determine position, velocity and time. Generally four satellite signals are used to compute position in three dimensions and a time offset in the receiver clock. A GPS satellite navigation system has three segments: a space segment, a control segment and a user segment.

The GPS space segment is comprised of a group of GPS satellites, known as the GPS Operations Constellation. A total of 24 satellites (plus spares) comprise the constellation, with the orbit altitude of each satellite selected such that the satellites repeat the same ground track and configuration over any point each 24 hours. There are six orbital planes with four satellites in each plane. The planes are equally spaced apart (60 degrees between each plane). The constellation provides between five and eight satellites visible from any point on the earth, at any one time.

The GPS control segment comprises a system of tracking stations located around the world. These stations measure signals from the GPS satellites and incorporate these signals into orbital models for each satellite. The models compute precise orbital data (ephemeris) and clock corrections for each satellite. A master control station uploads the ephemeris data and clock data to the satellites. The satellites then send subsets of the orbital ephemeris data to GPS receivers via radio signals.

The GPS user segment comprises the GPS receivers. GPS receivers convert the satellite signals into position, velocity and time estimates. Four satellites are required to compute the X, Y, Z positions and the time. Position in the X, Y and Z dimensions are converted within the receiver to geodetic latitude, longitude and height. Velocity is computed from change in position over time and the satellite Doppler frequencies. Time is computed in satellite time and GPS time. Satellite time is maintained by each satellite. Each satellite contains four atomic clocks that are monitored by the ground control stations and maintained to within one millisecond of GPS time.

Each satellite transmits two microwave carrier signals. The first carrier signal carries the navigation message and code signals. The second carrier signal is used to measure the ionospheric delay by Precise Positioning Service (PPS) equipped receivers. The GPS navigation message comprises a 50Hz signal that includes data bits that describe the GPS satellite orbits, clock corrections and other system parameters. Additional carriers, codes and signals are expected to be added to provide increased accuracy and integrity.

A system used to provide even greater accuracy for GPS systems used in navigation applications is known as Wide Area Augmentation System (WAAS). WAAS is a system of satellites and ground stations that provide GPS signal correction to provide greater position accuracy. WAAS is comprised of approximately 25 ground reference stations that monitor GPS satellite data. Two master stations collect data from the reference stations and produce a GPS correction message. The correction message corrects for GPS satellite orbit and clock drift and for signal delays caused by the atmosphere and ionosphere. The corrected message is broadcast through one of the WAAS geostationary satellites and can be read by a WAAS-enabled GPS receiver.

Some PGMs combine multiple types of guidance. For example, the Joint Direct Attack Munition (JDAM) uses GPS, but includes inertial guidance, which it uses to continue an engagement if the GPS signal becomes jammed.

A drawback associated with all these types of PGMs is the unintentional engagement of friendly or neutral targets. While LGBs have proven effective, a variety of factors such as sensor alignment, control system malfunction, smoke, dust, debris, and weather conditions can result in the LGB not hitting the desired target. SGMs may be confused by decoys. The image obtained by the SGM may be distorted by weather or battle conditions such as smoke and debris and result in the SGM not being able to lock onto the target. There are several areas where GPS errors can occur. Noise in the signals can cause GPS errors. Satellite clock errors, which are not corrected by the control station, can result in GPS errors. Ephemeris data errors can also occur. Tropospheric delays (due to changes in temperature, pressure and humidity associated with weather changes) can cause GPS errors. Ionospheric delays can cause errors. Multipath errors, caused by reflected signals from surfaces near the receiver that either interfere with or are mistaken for the signal, can also lead to GPS errors.

Despite the accuracy provided by LGBs, IGMs, SGMs, and GPR-based munitions the PGMs still occasionally inadvertently engage at or near friendly troops, sites, civilians, important collateral targets, and other unintended targets. This may be due to other factors as well, such as target position uncertainties, sensor errors, map registration errors and the like. This problem is increasingly important, both because domestic and world opinion is becoming increasingly sensitive to friendly fire and collateral damage, and because adversaries are more frequently deliberately placing legitimate military targets near potential targets of substantial collateral damage.

SUMMARY OF THE INVENTION

A method for providing integrity bounding of a weapon for use in weapon selection and targeting is presented. The method determines an integrity bound for the weapon, the integrity bound defining a zone around the target aim-point outside of which engagement can be confidently predicted to not occur within a predetermined integrity level (e.g., a probability of engagement within an allowable miss envelope). A method of assigning weapons for engaging a target is also presented. The method includes determining an aim-point of a target and determining an alert limit for the aim-point, the alert limit comprising a zone that includes the aim-point and excludes any known or hypothesized protected targets. Weapon selection is then performed by selecting a weapon having an integrity bound at the desired integrity level that is less than or equal to the alert limit.

With this arrangement, a quantified level of weapon integrity (i.e. an assurance of confidence of avoiding unwanted targets) is provided. The invention is in contrast to prior attempts to solve the problem of unintentional engagement of friendly sites which focused on developing weapons of high accuracy, and considering weapon accuracy in target assignment.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
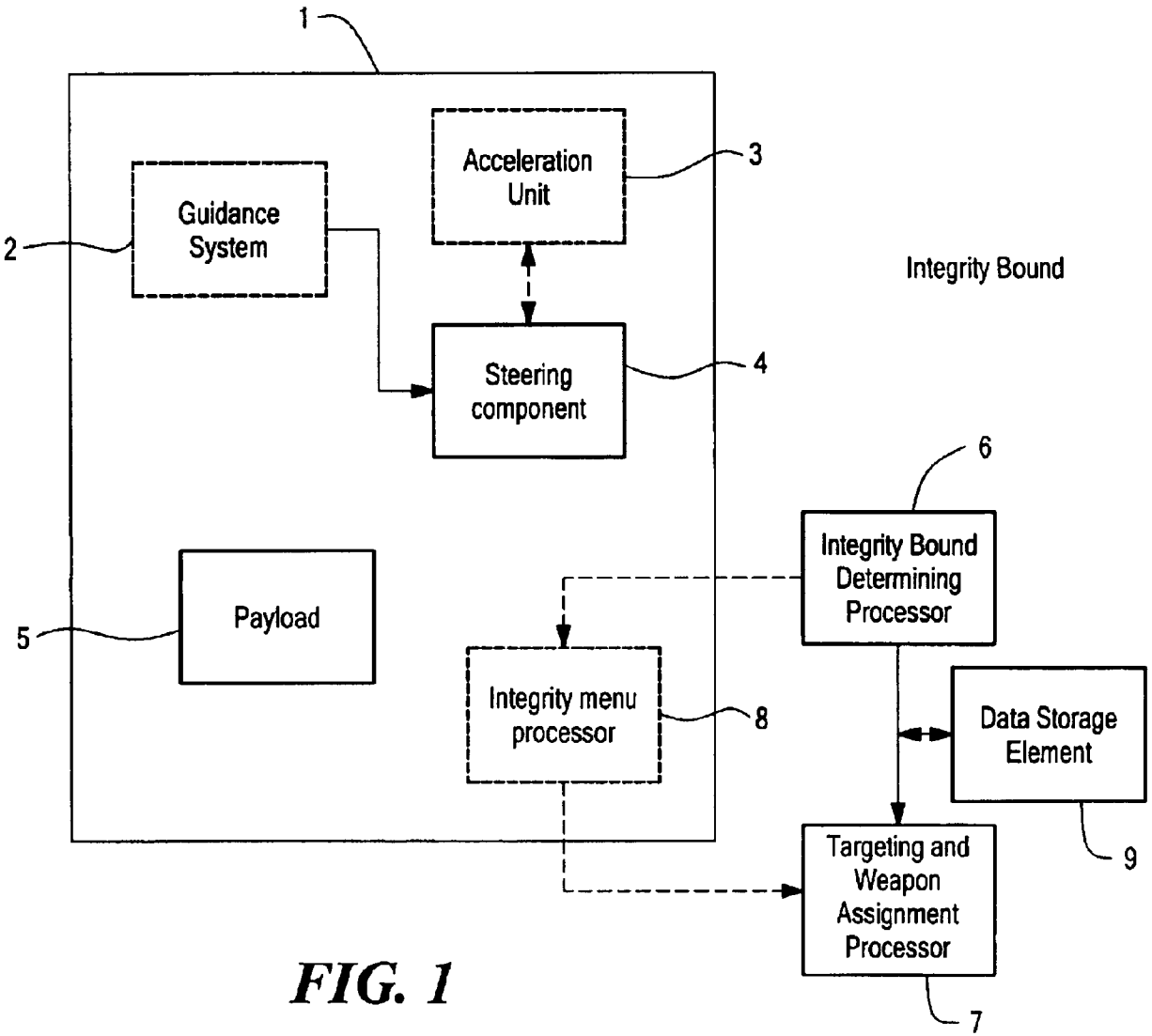
FIG. 1 is a block diagram of a munition.

A system and method for providing integrity bounding of a weapon is presented. The present invention develops evaluations of the off-nominal performance of a weapon, generating integrity bounds based on a priori calculations. These integrity bounds (and supporting parameter values) are then available for use in the selection of a weapon for a particular mission, in order to explicitly take into account nearby unwanted targets, and select a weapon with a tighter integrity bound than the allowable miss-distance to the nearest unwanted target.

It is desirable to be able to assign a weapon to a military target while maintaining confidence that the weapon has a very low probability of missing and hitting an identified nearby target that one wishes to avoid (such as a sensitive collateral damage candidate, or a friendly element). The weapon selection decisions should be made with explicit consideration of weapon integrity as a selection criteria.

Before describing the present invention, some introductory concepts and terminology are explained.

An "aim-point" is the ideal target location that a munition is intended to engage. The actual engagement may comprise a weapon impact, payload detonation, submunition deployment, or other weapon effect.

An "accuracy bound" is the likely area within which the munition is likely to strike to a desired certainty level. For example, a particular munition may have an accuracy bound of 25 meters at a level of 50% (i.e., that fifty percent of the munitions aimed at a target will impact within 25 meters of the target).

An "integrity bound" (also coincident at times to a "protection limit") defines a zone around a potential intended aim-point, within which the integrity of a miss can be assured to the corresponding probability level. That is, the munition must not engage outside the defined zone in order to meet a corresponding integrity level.

An "integrity level" is the probability that the weapon will not violate a desired bound. For the "integrity level" of the "integrity bound," it is the probability that the weapon will not engage on a point outside the integrity bound. The overall integrity level is the probability that the weapon will not have an excessive weapon effect outside the allowable engagement zone. For example, a particular munition may have an integrity bound of 50 meters at an integrity level of 99.9%. This means that on average no more than one out of one-thousand munitions aimed at a target will engage more than 50 meters from the target An "alert limit" is the zone that one wants to assure that munition engagement is constrained within, for example, the maximum zone that includes the aim-point and that excludes friendly sites.

An "allowable engagement zone" is a distance between an intended target and a protected target.

A "weapon effect area" is the zone around an engagement point in which the weapon has its payload effect. This size depends on the characteristics of the payload (e.g., submunition dispersal pattern, size of explosive charges, etc.) coupled with the vulnerability of the protected target (e.g. a protected bunker will have a smaller weapon effect area against an explosive charge than an open vehicle.)

A "weapon effect area uncertainty" is the potential variability in the weapon effect area. For example, there may be uncertainty in the exact height the detonation occurs at, submunitions may flutter or otherwise have variability in their deployed flight paths (and thus in their impact area), explosives may have a small probability of a different detonation pattern, etc.

Referring to FIG. 1, an exemplary munition 1 is shown. Munition 1 includes a steering component 4 and a payload 5. In some embodiments munition 1 may also include a guidance system 2 and an acceleration unit 3. Examples of munitions include Joint Direct Attack Munitions (JDAMs), Tomahawk missiles and Joint Standoff Weapon (JSOW) munitions. JDAMs and JSOWs are glide bombs, while the Tomahawk is a powered cruise missile. Different munitions can be provided with various payloads 5. For example, a JSOW is illustrative of different payloads, with variants including 145 combined-effect submunitions {AGM-154A (Baseline JSOW)}, 24 anti-armor submunitions {AGM-154B (Anti-Armor)}, and a 500 lb bomb {AGM-154C (Unitary Variant)}.

The steering component 4 may be an active steering component or a passive steering component. An active steering component is used to direct the munition 1 to a predetermined target under the control of the guidance system 2. The active steering component comprises actuators (typically realized as controllable fins) that create aerodynamic torques and forces which cause the munition to follow a desired flight path. A passive steering component comprises fixed fins which cause the munition to proceed along a desired flight path. Alternately, an acceleration unit 3 may be included for certain types of munitions such as Tomahawk guided missiles.

The guidance system 2 is in communication with steering component 4 and the integrity bound determining processor 6. The guidance system may be one of a LGS, IGS, SGM, or a GPS, all of which are described above.

The integrity bound determining processor 6 is used to determine the integrity bound for the munition at a given accuracy level. The integrity bound information may be stored in data storage device 9 in some embodiments. The process of determining the integrity bound and related information is described in detail below.

The targeting and weapon assignment processor 7 receives the integrity bound and related information from the integrity bound determining processor 6 or from data storage device 9. The targeting and weapon assignment processor 7 determines the targeting of enemy sites and the appropriate weapons to use in the engagement of the enemy sites, using the integrity bound and related information. Alternately, the target and weapon assignment processor 7 receives data from an integrity menu processor 8 located within munition 1. The integrity menu processor 8 receives a plurality of munition integrity bounds and associated integrity levels from the integrity bound determining processor 6, and allows for selection of one of the plurality of integrity bounds and associated integrity level for the munition.

Each munition, for a given integrity level, has a respective "integrity bound" which defines the area outside of which the munition may not engage in order to meet the integrity bound. For example, a particular munition may have an integrity bound of 20 meters to meet an integrity level of 0.999 and an integrity bound of 33 meters to meet an integrity level of 0.9999. In a particular use of the munition, it is provided an "alert limit" and a corresponding "integrity threshold." The alert limit is the region beyond which the munition is commanded not to engage, and the integrity threshold for the engagement is the commanded probability that munition will not engage beyond this alert limit. The alert limit can be provided implicitly, by taking the munition's integrity bound as the default alert limit. Similarly, the integrity threshold for the engagement can be provided implicitly by taking the munition's integrity level corresponding to the alert limit as the default integrity threshold. Once the integrity threshold and corresponding alert limit are known, the integrity verification is a determination, based on sensor input, that the munition will not engage beyond the alert limit.

Figure 2:
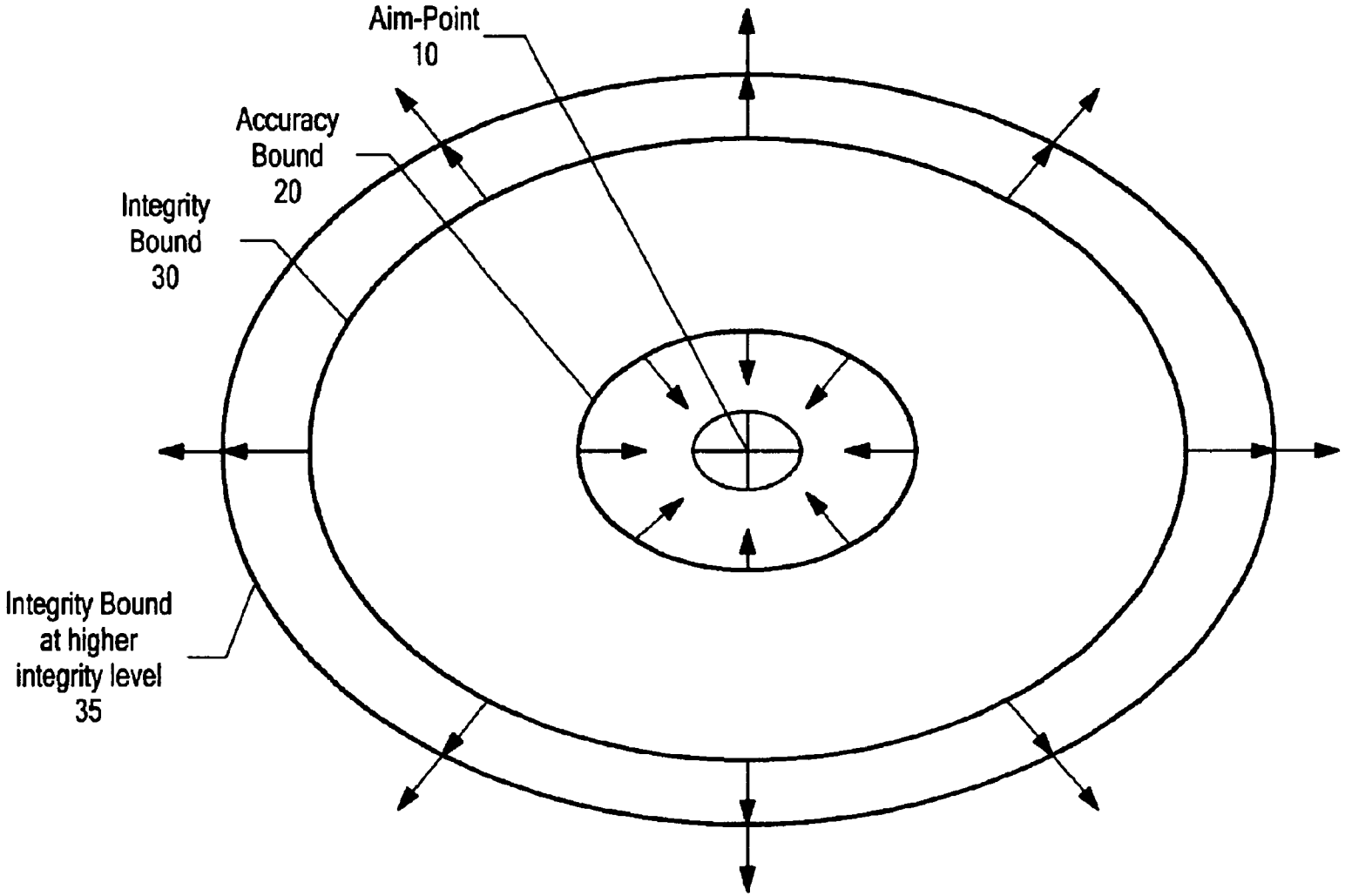
FIG. 2 is a diagram showing an aim-point, an accuracy bound and an integrity bound.

Referring now to FIG. 2, a traditional targeting aim-point 10 is shown. Surrounding aim-point 10 is an accuracy bound 20. As defined above, the accuracy bound defines the likely area within which the PGM is likely to strike to a desired certainty level. A PGM can have different accuracy bounds, both in terms of accuracy and in the area of the bound. Different PGMs will have different integrity bounds as well. For example, a Tomahawk cruise missile PGM with a GPS guidance system may have an accuracy of 90% within a 10 meter bound, while a JDAM having an IGS may have an accuracy of 50% within a 30 meter bound. Thus, if the aim-point were an enemy communications center, and the accuracy bound were 20 meters with a 50% accuracy, then half of the munitions aimed at the enemy site would strike within 20 meters of the site. The munition chosen would then either need to be effective to destroy the communications center, or a certain number of munitions may need to be fired at the enemy site in order to destroy the communications center. A direct effect of this is that while half of the munitions aimed at the enemy site will hit within 20 meters of the site, the other half will hit outside the accuracy bound, potentially hitting friendly sites. Accuracy bounds are generally determined from empirical data such as testing, modeling and statistical analysis.

An integrity bound 30 is shown surrounding the accuracy bound 20. As defined above, the integrity bound 30 defines a zone around a potential intended aim-point 10 within which the integrity of a miss can be assured to the corresponding probability level. A particular munition may have several integrity bounds, each integrity bound defining a different sized zone and having an associated accuracy level. Using the example above, in which the accuracy bound defines a zone extending 20 meters from an aim-point with a 50% accuracy, the same munition may have an integrity bound defining a zone extending 50 meters from the aim-point at a 99.9% integrity level. This means that 1 out of 1,000 munitions will hit outside the integrity bound 30. The manner in which integrity bounds are determined will be described in detail below.

A second integrity bound 35 is also shown. Integrity bound 35 is shown surrounding integrity bound 30. In the example described above, wherein integrity bound 30 defined a zone extending 50 meters from an aim-point at 99.9% integrity level, integrity bound 35 defines a larger zone at a higher integrity level, for example a zone extending 70 meters from an aim-point at a 99.99% integrity level.

Figure 3:
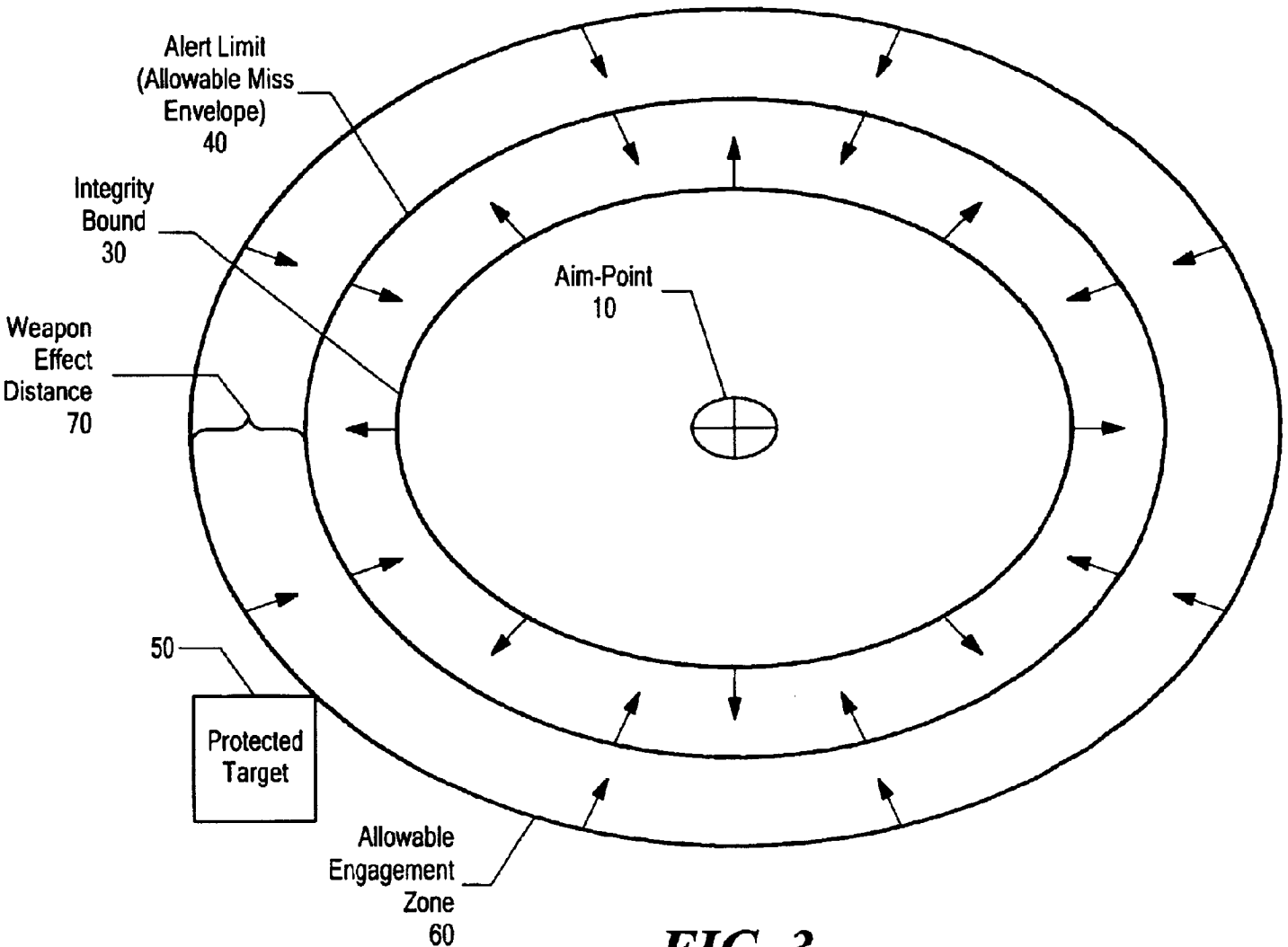
FIG. 3 is a diagram showing an aim-point, an integrity bound, an allowable miss envelope, a protected target and an allowable engagement zone.

Referring now to FIG. 3, the same aim-point 10 and integrity bound 30 are shown. Also shown are an alert limit (also referred to as an allowable miss envelope) 40 and a protected target 50. The alert limit is a commanded value. The alert limit 40 defines the area within which a munition's integrity bound 30 must lie in order to be considered as a potential munition to be used in targeting of aim-point 10. For example, if the alert limit were 60 meters, then any munition having an integrity bound of less than 60 meters could be included in the determination of which munition to use for targeting aim-point 10. Any munition having an integrity bound greater than the alert limit of 60 meters would not be considered, since there is a chance the munition could unintentionally engage protected target 50. Also shown is an allowable engagement zone 60 which surrounds the alert limit 40 and is directly adjacent the protected target 50. The area between the alert limit 40 and the allowable engagement zone 60 is defined as the weapon effect distance.

Figure 4:
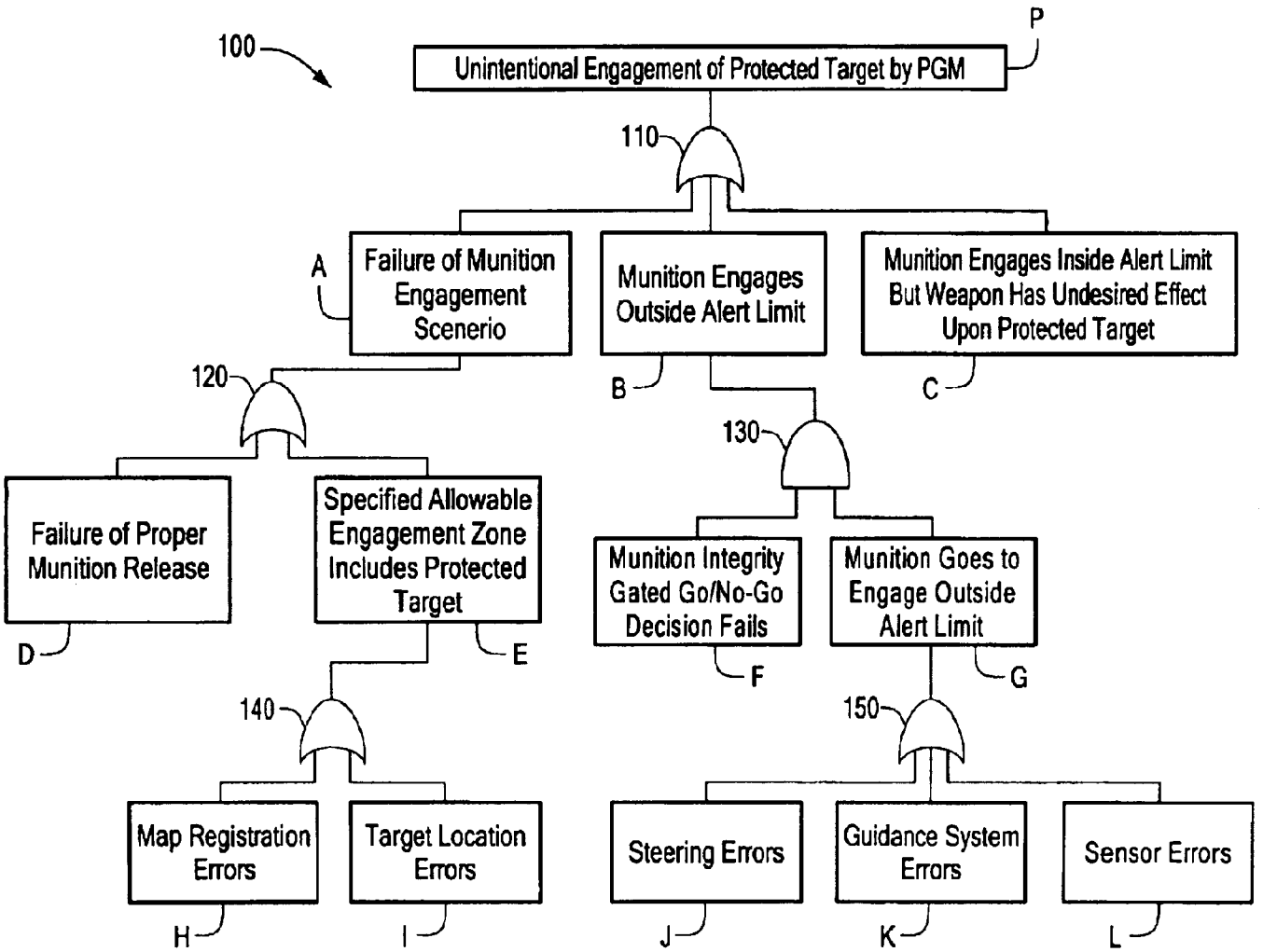
FIG. 4 is a fault tree for a precision guided munition.

The process for determining the integrity bound will now be described. Referring to FIG. 4, a fault tree 100 for an exemplary munition is shown. Fault trees are known to those of ordinary skill in the art, and are described in detail in SAE ARP4761, which is incorporated by reference herein. Fault tree 100 is a simplified tree for the sake of explanation. It should be appreciated that fault trees can have several levels and several nodes at each level. The fault tree 100 includes a node P which comprises a top-level description of the problem, in this case the unintentional engagement of friendly sites by a PGM.

The top-level problem (node P) can occur as a result of an error in any one of the nodes A, B, or C. Since in this example any one of the nodes A–C can cause the problem, all the nodes A–C are connected to respective inputs of an OR gate 110. The output of OR gate 110 is connected to node P. If each of two or more of the nodes were required in order to achieve the error, those nodes would be shown logically connected to an AND gate.

A second level of the fault tree contains nodes A, B, and C. Node A represents errors due to failure of the munition engagement scenario. There are several factors which can lead to a failure of the munition engagement scenario, for example, movement of the enemy troops.

Node B represents errors due to the munition engaging outside the alert limit. The factors which can lead to this error are shown as nodes F and G, and are described below.

Node C represents errors due to the munition engaging inside the alert limit, however the weapon has had an undesired effect upon a protected target. This can occur when the actual weapon effect distance exceeds the expected maximum weapon effect distance. For examples, the protected target is not as hard (resistant to weapon damage) as expected, the detonation is unexpectedly shaped in a "bad" way, or the submunition dispersal is wider than expected.

A third level of the fault tree contains nodes D, E, F and G. Node D represents errors relating to the failure of a proper munition release.

Node E represents errors wherein the specified engagement zone includes a protected target. The factors leading to this type of error are shown as nodes H and I, and are described below.

Node F comprises errors wherein a munition integrity gated go/no-go decision fails. There can be a variety of factors as to the reason this happens. These factors may include loss of a guidance system signal, multipath errors, changes in the atmospheric temperature, pressure or humidity and the like.

Node G comprises errors wherein the munition goes to engage outside alert limit. AND gate 130 is shown with nodes F and G as inputs and the output connecting to node B, therefore the error associated with node B occurs when both the error at node F and the error at node G occur.

A fourth level of the fault tree includes nodes H, I, J, K and L. Node H represents errors due to map registration errors. These errors occur when the map being used isn't exactly accurate in its depiction of a location of a site.

Node I represents errors due to target location errors. These errors are due to errors in the reporting of target locations by friendly troops, movement of the target or the like. OR gate 140 is shown with nodes H and I as inputs and the output connecting to node E, therefore the error associated with node E occurs when either or both the error at node H or the error at node I occur.

Node J represents errors relating to steering errors. Steering errors can occur when there is a malfunction in the steering of the PGM, for example by a fin actuator failing.

Node K represents errors relating to guidance system errors. There are several factors which can cause a guidance system error.

Node L represents sensor errors. Certain munitions include sensors for sensing a variety of factors such as the presence of guidance signals, detection that the traversal along a flight path is being maintained, weather conditions, and the like. The sensors can have certain errors or failures. OR gate 150 is shown with nodes J, K and L as inputs and the output connecting to node G, therefore the error associated with node G occurs when any of the error at node J, or the error at node K or the error at node L occur.

The fault tree 100 is used to provide a Boolean representation of fault conditions. For the present example, the second level of the tree can be represented as Equation 1:

$$A+B+C=P \qquad \text{(Eq. 1)}$$

wherein a "+" represents the logical OR function, P represents the top-level problem node, and A, B, and C are the nodes representing conditions that can result in the problem. That is, failure of the munition engagement scenario (node A) or the munition engaging outside the alert limit (node B) or the munition engaging within the alert limit but the weapon has an undesired effect on a protected target can cause the unintentional engagement of a protected target by a PGM (node P).

The next level of the fault tree comprises nodes D, E, F and G. Either of Node D or Node E lead to the failure of the munition engagement scenario.

The combination of node F and node G lead to the munition engages outside alert limit. This level of the tree can be represented by the equations:

$$D+E=A \quad \text{(Eq. 2)}$$

$$F\cdot G=B \quad \text{(Eq. 3)}$$

Wherein a "+" represents the logical OR function, a "·" represents the logical AND function, A is the failure of the munition engagement scenario, nodes D and E are the nodes representing conditions that can result in the failure of the munition engagement scenario, B is the munition engages outside alert limit error node, and nodes F and G are the nodes representing conditions that can result in the munition engages outside alert limit error. That is, a munition integrity gated go/no-go decision failure (node F) and a munition goes to engage outside area limit (node G) can cause a munition engages outside alert limit error (node B). Equation 2 can be substituted into Equation 1 to result in Equation 4:

$$D+E+B+C=P \quad \text{(Eq. 4)}$$

Equation 3 can be substituted into Equation 4 to result in Equation 5:

$$D+E+(F\cdot G)+C=P \quad \text{(Eq. 5)}$$

The next level of the fault tree comprises nodes H, I, J, K and L. Node H and node I together provide the error at node E. This can be represented by the equation:

$$H+I=E \quad \text{(Eq. 6)}$$

Where E is the specified allowable engagement zone including a protected target error and nodes H and I are the nodes representing conditions that can result in the error. That is, one or both of a map registration error (node H) or a target location error (node I) lead to the specified allowable engagement zone including a protected target (node E). Equation 6 can be substituted into Equation 5 to result in Equation 7:

$$D+H+I+(F\cdot G)+C=P \quad \text{(Eq. 7)}$$

Node J, node K and node L together provide the error at node G. This can be represented by the equation:

$$I+J+K=G \quad \text{(Eq. 8)}$$

Where G is the munition goes to engage outside alert limit error and nodes J, K and L are the nodes representing conditions that can result in the error. That is, a steering error (node J) and a guidance system error (node K) and a sensor error (node L) lead to the munition goes to engage outside alert limit error (node G). Equation 8 can be substituted into Equation 7 to result in Equation 9:

$$D+H+I+(F\cdot(I+J+K))+C=P \quad \text{(Eq. 8)}$$

The integrity bound is determined by use of the fault tree 100. This is accomplished by starting with the goal failure probability at top, and allocating numbers that seem reasonable for the particular failure modes and propagating through the various levels. For OR gates, the higher level number is distributed between the lower level nodes to determine a failure rate for each node. For AND gates, the log of the failure rate is taken (which will be negative), the log of the failure rate is distributed between lower level failure nodes, and then the inverse of log for probabilities is taken.

As an example, node P needs to have an integrity bound where only 1/1000 munitions will strike outside the integrity bound. Traversing the fault tree from node P downward, nodes A–C are the next level, and are coupled to node P by an OR gate 110. The integrity level of 1/1000 is then distributed amongst the three nodes A–C in proportion to their relative ease of achieving such error rates. For example, if avoiding each failure is equally easy, then each of nodes A–C is allocated a respective error rate of 1/3000.

At the next level down are nodes D–G. Nodes D and E are ORed together to node A, therefore node A's error rate is distributed between nodes D and E. For example, if avoiding failures of type D is twice as difficult as avoiding failures of type E, then node D is allocated a failure rate of 1/9000 and node E is allocated a failure rate of 1/4500. Nodes F and G are ANDed together for node B. Therefore, the log of node B's failure rate of 1/3000 is determined (−3.477). This value is then distributed between the by two nodes in proportion to their relative difficulty of achievement. If avoiding the failures of the two nodes are equally challenging, then each node is allocated a value of one half the calculated log (−1.739). The failure rate for each of nodes F and G is then obtained by taking the inverse log of −1.739, which is 0.0182 which equates to a failure rate of 1/55 for each of nodes F and G.

At the last level of the fault tree are nodes H–L. Nodes H and I are ORed together to get node E, therefore Node E's failure rate is distributed between the two nodes H and I, resulting in an failure rates of 1/9000 for each of these nodes if there is an even distribution between the two nodes. For nodes J–L, the failure rate of node G 0.0182 is distributed between nodes J–L. If avoiding failures of type K is twice as difficult as avoiding failures of type J, and avoiding failures of type L is three times as difficult as avoiding failures of type J, then the allocation would be a 0.00303 failure rate for Node J, a 0.00607 failure rate for Node K, and a 0.00910 failure rate for Node L. These correlate to failure rates of 1/330 for node J, 1/165 for node K and 1/110 for node L.

At this point, the failure rate for each lowermost node of the fault tree has been determined. These lowermost nodes include nodes C, D, F, H, I, J, K and L. At each of these nodes, the error size for the given failure rate is determined. The error size for a given failure rate may be obtained from empirical data, simulations, or other data. This error size must confidently bound the actual error size corresponding to the selected failure rate at a probability commensurate with the failure rate. For very small failure rates, this is likely to be based on a curve of bounding error size that provides margin to assure the high confidence that the bounding error size is greater than the actual error size. The bounding curve will address uncertainties in how much the estimate of error size based on empirical data, simulation, or other data might vary from the underlying real probability distribution. For example, node C has an allocated failure rate of 1/3000, and may be known from empirical data to have a bound error size of 30 meters at this failure rate. Node K has an allocated failure rate of 0.0607 and may have a bound error size of 10 meters at this probability. The bound error size for each of nodes C, D, F, H, I, J, K and L are determined. For the simplest approach, the sum of these bound error sizes is used as the overall munition integrity bound. For example, if the sum of bound error sizes for nodes C, D, F, H, I, J, K and L at their associated failure rates was 60 meters, then the integrity bound for the entire munition at the level of 1/1000 at node P would be no greater than 60 meters.

A more complex approach requires curves of bound error size for the lowermost nodes of the error tree as a function of the probability of failure. These curves are more extensive sets of the sort of data used to generate the bound on the estimate error size for a particular error rate used in the simpler approach above. As such, they are also obtained from empirical data, simulations, or other data, provide margins to bound the estimate, and may use different sources of data to define different portions of the curve. This more complex approach then takes the mathematical convolution of bound error size versus failure rate curves for the component nodes to generate a curve of bound error size as a function of failure rate at the next-higher node. This process is then aggregated upwards, until the corresponding curve is generated for the topmost node. Selecting the point on that curve that corresponds to the overall integrity failure rate yields the resulting integrity bound. A process of medium complexity may mix these two approaches at different intermediate nodes, compiling from the bottom nodes up a final integrity bound for the top-level integrity failure rate.

Figure 5:
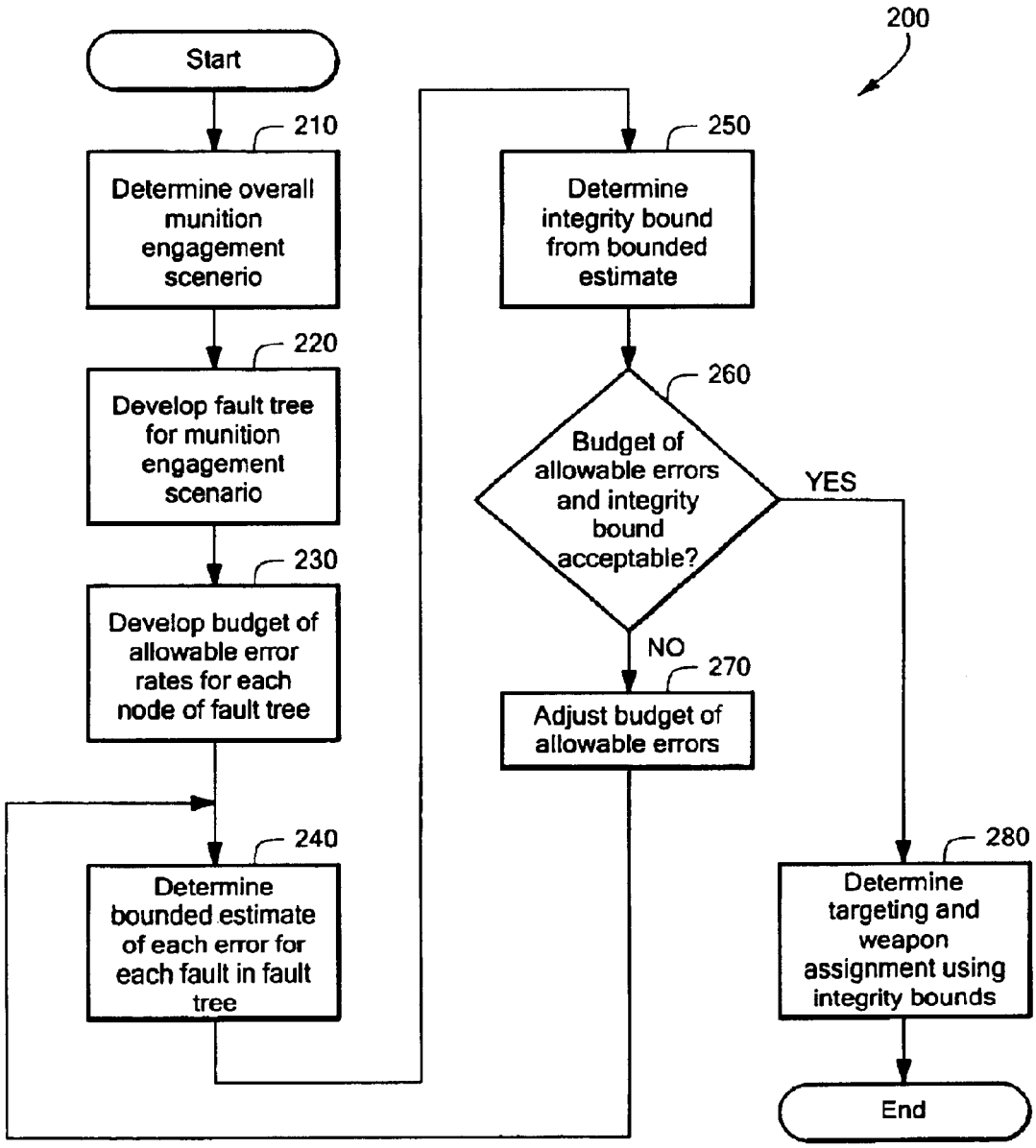
FIG. 5 is a flow diagram of a method for determining an integrity bound of a weapon in accordance with the invention.
Figure 6A:
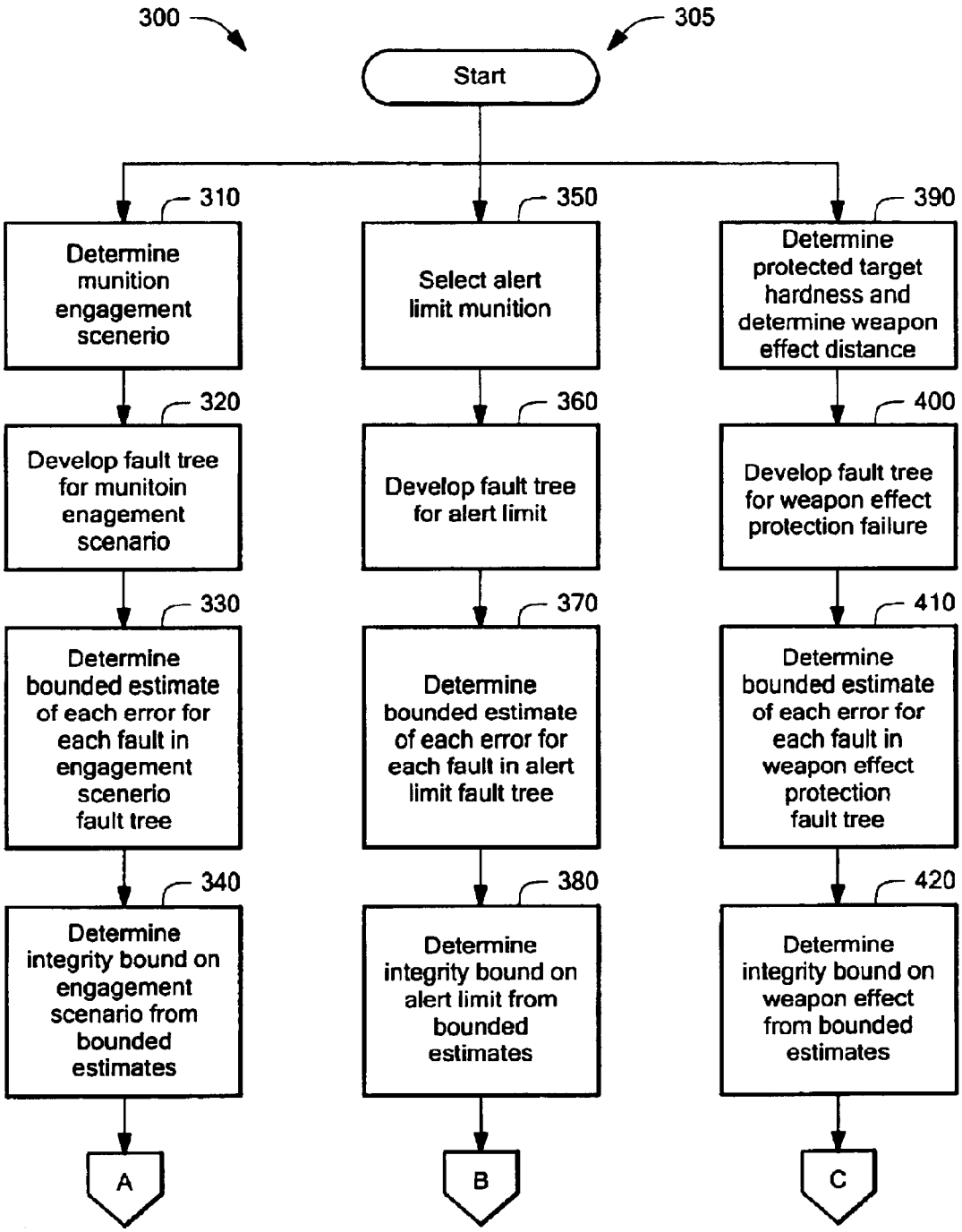
FIG. 6A is a first part of a flow diagram for another method for determining an integrity bound of a weapon in accordance with the present invention.
Figure 6B:
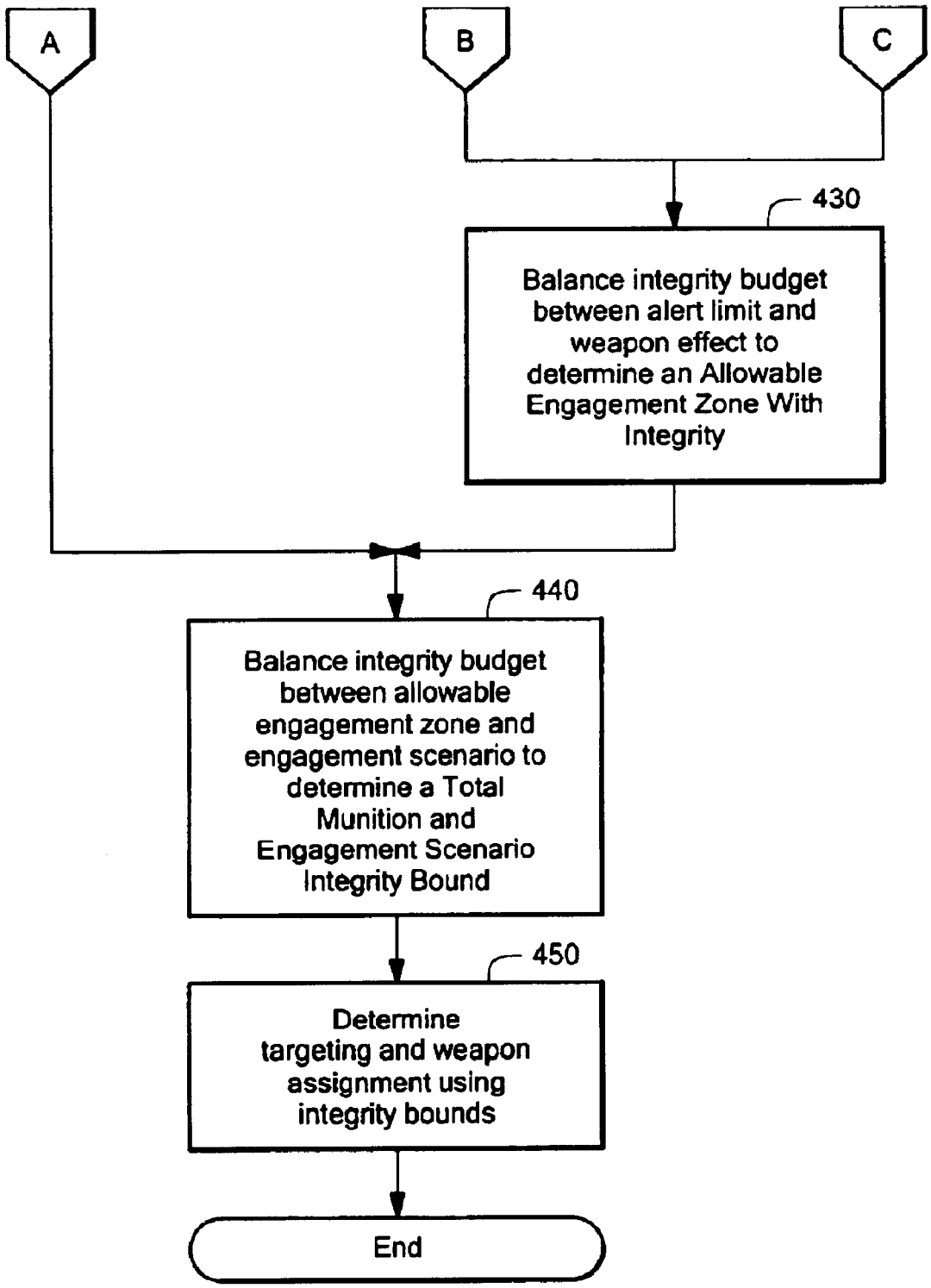
FIG. 6B is a second part of the flow diagram of FIG. 6A.

The purpose of adjusting failure rate budgets, as described in step 270 of FIG. 5, and as a component of the process within steps 430 and 440 of FIG. 6B, is to allow adjustments between error rates that operate through the associated error sizes to improve the overall integrity bound.

As described above, the weapon effect area, weapon effect area uncertainty, and weapon engagement location uncertainty are all included in the development of an overall munition integrity bound. Once the integrity bound has been determined, this information as utilized as part of the targeting and weapon selection decision. As such, weapon target assignment is made based on explicit confidence of avoidance of nearby friendly and collateral targets.

A flow chart of the presently disclosed methods are depicted in FIG. 5 and FIGS. 6A and 6B. The rectangular elements are herein denoted "processing blocks" and represent computer software instructions or groups of instructions. The diamond shaped elements, are herein denoted "decision blocks," represent computer software instructions, or groups of instructions which affect the execution of the computer software instructions represented by the processing blocks.

Alternatively, the processing and decision blocks represent steps performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and can be varied without departing from the spirit of the invention. Thus, unless otherwise stated the steps described below are unordered meaning that, when possible, the steps can be performed in any convenient or desirable order.

Referring now to FIG. 5, a flow chart of the present method 200 is shown. The first step 210 is to define the overall munition engagement scenario. This is done by selecting a scenario of interest, including a munition of interest. The scenario includes specification of the munition, how the munition should be deployed, the allowable engagement zone, information about the context of the engagement that allows one to determine the probability that the specified allowable engagement zone includes protected target(s) and the hardness of the protected target(s).

In step 220, a comprehensive fault tree for the munition engagement scenario is developed. An illustrative partial fault tree 100 is shown in FIG. 4. The fault tree is used in the determination of an integrity bound for a particular weapon.

In step 230, a budget of allowable error rates for each node in the fault tree is developed. Each node in the fault tree relates to a particular error.

In step 240, a bounded estimate of the error size induced by each fault in the fault tree is provided. If sufficient test data to be statistically significant at the desired probability of failure is reasonably available, a selection from the error size as a function of probability of the error size corresponding to the allocated probability of failure is made, with margins to address statistical uncertainty between the estimated curve and the underlying distribution. This may not be feasible for lower probabilities of failure, typically due to the large amounts of test data required. In these cases, an analytic model of the failure mode is provided in context, including expected variation in failure characteristics that result in variation in error size. This model creates a probability distribution of error size by error model, and a probability distribution on a confident bound on the error size. It is necessary to show that the probability distribution for bound error size does bounds the underlying probability distribution for error size (i.e., at low probabilities, the error will not be greater at that probability than estimated). The error and bounding models are preferably validated against physical laws and test data.

In step 250, an integrated probability and corresponding integrity bound or probability curve as a function of integrity bound are determined. This is a roll-up of the corresponding bound errors sizes, combined by characteristics of fault mode. Generally, "combined by characteristics of fault mode" will mean simply adding bound error sizes for point estimates, or directly convoluting bound error sizes for probability distributions. In some cases, however, the error modes will not add linearly, and the mathematical combination will be more challenging, such as the translation from azimuth or alignment error to final position error.

In step 260, a determination is made as to whether the budget of allowable errors and the integrity bound are acceptable. In order for the integrity bound to be deemed acceptable, it is required that the integrity bound be less than alert limit. If the overall integrity level cannot be met, then a looser integrity level (i.e., higher probability of failure) can be used, or the engagement scenario will need to be altered (which can include changing the expected characteristics of the munition, if still at a point where the munition is being designed). In some instances it is possible to decide that the allowable error budget and integrity bound are not acceptable, because the bound is much smaller than the alert limit, and thus an integrity bound at a higher integrity level should be considered. If the budget of allowable errors and the resultant integrity bound are acceptable, then step 280 is executed, if not then step 270 is executed. There can be a very long period of time between step 260 and step 280. This may optionally be facilitated through long-term data storage of the results of step 260, as a precursor to step 280.

In step 270, the budget of allowable errors is adjusted to bring the overall integrity level or the integrity bound closer to desired goals, or to move probability of failure between nodes to reduce the overall integrity bound. Steps 240 et seq. are then executed.

In step 280, the integrity bound is used in determining targeting and weapon-target assignment. The integrity bound is used in combination with knowledge about potential friendly or collateral damage targets near the intended aim-point as criteria in the targeting and weapon-target assignment determination. As an example, a ground-rule could be established that weapons will not be targeted on aim-points that include within the weapon integrity bound known friendly or important collateral damage targets. Steps 220 through 270 may be repeated for different overall integrity levels, providing a menu of integrity levels and corresponding integrity bounds. Selection between these choices may then be included in the targeting and weapon assignment criteria.

Referring now to FIGS. 6A and 6B, a further embodiment of a method 300 for providing integrity bounding of a weapon for use in weapon selection and targeting is shown. This method 300 decomposes into independent processes the treatment of the engagement scenario, the alert limit and the weapon effect, thus simplifying the process, and facilitating the downstream combination of integrity components in the development of targeting and weapon assignments. The method 300 starts at step 305 wherein three paths branch. Each path may be performed in parallel or each path may be performed serially. If the paths are performed serially, they can be performed in any order.

The first path begins with step 310 wherein the munition engagement scenario is defined. The scenario includes specification of the munition, how the munition should be deployed, and information about the context of the engagement that allows one to determine the probability that the specified allowable engagement zone includes protected target(s).

In step 320, a comprehensive fault tree for the munition engagement scenario is developed. A sample fault tree 100 is shown as node A and subsidiary nodes in FIG. 4. The fault tree is used in the determination of an integrity bound for a particular munition.

In step 330, a bounded estimate of the error induced by each fault in the engagement scenario fault tree is provided. As described above, if sufficient test data to be statistically significant at the desired probability of failure is reasonably available, a selection from the bound error size as a function of probability of the bound error size corresponding to the allocated probability of failure is made. This may not be feasible for lower probabilities of failure. In these cases, an analytic model of the failure mode is provided in context, including expected variation in failure characteristics that result in variation in error size. This model creates a probability distribution of bound error size given the error model. It is necessary to show that the probability distribution used to model the bound error size actually bounds the underlying probability distribution of error size (i.e., at low probabilities on the curve, the error probability of error will not be greater at that bound error size than the actual probability that is being estimated).

In step 340, an integrated probability and corresponding integrity bound or probability curve as a function of integrity bound arc determined. This is a roll-up of the corresponding bound error sizes, combined by characteristics of fault mode. Generally, "combined by characteristics of fault mode" will mean simply adding bound error sizes for point estimates, or convolving probability distributions. In some cases, however, the mathematical combination will be more challenging, such as the translation from azimuth or alignment error to final position error. This ends the first path.

The second path begins with step 350 wherein the alert limit for a munition is selected. A selected individual value or a list of parametric values or a selection within a range of interest is done.

In step 360, a comprehensive fault tree for the alert limit is developed. A sample fault tree 100 is shown as node B and subsidiary nodes in FIG. 4. The alert limit fault tree is used in the determination of an integrity bound for a particular munition.

In step 370, a bounded estimate of the error induced by each fault in the alert limit fault tree is provided. This is described in detail above in the description of step 330.

In step 380, an integrated probability and corresponding integrity bound or probability curve as a function of integrity bound are determined. This is described above with respect to step 340. This ends the second path.

The third path begins with step 390 wherein the protected target hardness (resistance to damage) and weapon effects are defined. Weapon effects arc taken from definition of munition, either real for real munition, or proposed payload for hypothesized munition. Hardness is taken from description/categorization of identified or hypothesized protected target.

The third path begins with step 390 wherein the protected target hardness (resistance to damage) and weapon effect distance are defined. The scenario includes how the weapons should be deployed, and what targets are to be engaged.

In step 400, a comprehensive fault tree for the weapon effect protection failure is developed. A sample fault tree 100 is shown in FIG. 4. The fault tree is used in the determination of an integrity bound for a particular munition, as described in detail above.

In step 410, a bounded estimate of the error induced by each fault in the weapon effect protection fault tree is provided.

In step 420, an integrated probability and corresponding integrity bound or probability curve as a function of weapon effect distance are determined. This ends the third path.

In step 430 an Allowable Engagement Zone with Integrity is produced by balancing the integrity budget between the alert limit (second path) and the weapon effect (third path).

In step 440 a Total Munition and Engagement Scenario Integrity Bound is determined by balancing the integrity budget between the Allowable Engagement Zone with integrity and the engagement scenario (first path).

In step 450 the integrity bound is used in the determination of targeting and weapon assignment. There can be a very long period of time between steps 340, 380 and 420 and step 450. This may optionally be facilitated through long-term data storage of the results of steps 340, 380, 420, optionally 430, and optionally 440.

A method for providing integrity bounding of a weapon for use in weapon selection and targeting has been described. The method determines an integrity bound for the weapon, the integrity bound defining a zone around the target aim-point within which engagement must occur to meet a predetermined integrity level (i.e., a probability of engagement within an allowable engagement zone). A method of assigning weapons for engaging a target is also presented. The method includes determining an aim-point of a target and determining an alert limit for the aim-point, the alert limit comprising a zone that includes the aim-point and excludes any friendly sites. Weapon selection is then performed by selecting a weapon having an integrity bound less than or equal to the alert limit.

Having described preferred embodiments of the invention it will now become apparent to those of ordinary skill in the art that other embodiments incorporating these concepts may be used. Additionally, the software included as part of the invention may be embodied in a computer program product that includes a computer useable medium. For example, such a computer usable medium can include a readable memory device, such as a hard drive device, a CD-ROM, a DVD-ROM, or a computer diskette, having computer readable program code segments stored thereon. The computer readable medium can also include a communications link, either optical, wired, or wireless, having program code segments carried thereon as digital or analog signals. Accordingly, it is submitted that that the invention should not be limited to the described embodiments but rather should be limited only by the spirit and scope of the appended claims. All publications and references cited herein are expressly incorporated herein by reference in their entirety.

What is claimed is:

1. A method for providing integrity bounding of a weapon comprising:

determining a target aim-point for said weapon; and determining an integrity bound for said weapon around said aim-point, said integrity bound defining a zone around said aim-point outside of which an engagement will not occur with a predetermined integrity level.

2. The method of claim 1 wherein said determining an integrity bound comprises:

developing a fault tree for said weapon;

developing a budget of allowable error rates for each fault of said fault tree;

determining a bounded estimate of each error for each fault in said fault tree based on the budgeted error rate of each said fault; and producing an integrity bound from said bounded estimates.

3. The method of claim 2 wherein said developing a budget of allowable error rates for each fault of the fault tree comprises:

traversing nodes from a top node to a bottom node:

for nodes that are logically ORed together, taking the error rate of the node connected to the output of the OR gate and distributing it among the nodes connected to the inputs of said OR gate;

for nodes that are ANDed together, taking the error rate of the node connected to the output of the AND gate, taking the log of the error rate, distributing the log of the error rate between the nodes connected to the inputs of the AND gate to get intermediate error rate measures, and taking the inverse log of the intermediate error rate measures to get the node error rate for each node connected to the inputs of the AND gate.

4. The method of claim 3 further comprising identifying nodes that do not have another node coupled thereto, and determining an integrity bound for that node based on the error rate determined for that node.

5. The method of claim 4 further comprising taking the sum of the largest bound error size at each allocated error rate of all bottom nodes in the fault tree, and making the munition integrity bound equal to said sum.

6. The method of claim 5 further comprising developing a bound error size probability distribution for each higher level node by convolving the probability distributions of bound error size for all the immediately lower nodes of each higher level node, and selecting from a resulting curve at the top node a bound error size at a probability equal to the desired integrity level as the munition integrity bound equal to said sum.

7. The method of claim 6 further comprising assessing one or more intermediate nodes as if they were the highest node, and using these values to complete the evaluation of the integrity bound.

* * * * *

UNITED STATES PATENT AND TRADEMARK OFFICE

CERTIFICATE OF CORRECTION

PATENT NO. : 6,796,213 B1 
APPLICATION NO. : 10/444938
DATED : September 28, 2004
INVENTOR(S) : McKendree et al.

It is certified that error appears in the above-identified patent and that said Letters Patent is hereby corrected as shown below:

Column 2, line 46 delete “Position in the” and replace with --Positions in the--.

Column 4, line 3 delete “assignment.” and replace with --assignments.--.

Column 6, line 11 delete “integrity level” and replace with --integrity levels--.

Column 7, line 28 delete “adjacent the protected” and replace with --adjacent to the protected--.

Column 7, line 66 delete “For examples,” and replace with --For example,--.

Column 8, line 48 delete “any of the error” and replace with --any of the errors--.

Column 9, line 59 delete “at top,” and replace with --at the top,--.

Column 10, line 18 delete “between the by two nodes” and replace with --between the two nodes--.

Column 10, line 27 delete “Node E’s” and replace with --node E’s--.

Column 10, line 29 delete “resulting in an failure” and replace with --resulting in failure--.

Column 10, line 36 delete “Node J, a 0.00607 failure rate for Node K,” and replace with --node J, a 0.00607 failure rate for node K,--.

Column 10, line 37 delete “Node L.” and replace with --node L.--.

Column 11, line 30 delete “as utilized” and replace with --is utilized--.

Column 14, lines 64-65 delete “invention it will” and replace with --invention, it will--.

UNITED STATES PATENT AND TRADEMARK OFFICE

CERTIFICATE OF CORRECTION

PATENT NO. : 6,796,213 B1
APPLICATION NO. : 10/444938
DATED : September 28, 2004
INVENTOR(S) : McKendree et al.

It is certified that error appears in the above-identified patent and that said Letters Patent is hereby corrected as shown below:

Column 15, line 10 delete "submitted that that the" and replace with --submitted that the--.

Signed and Sealed this

Twelfth Day of December, 2006

JON W. DUDAS
*Director of the United States Patent and Trademark Office*